United States Patent [19]

Nethersole et al.

[11] 4,069,792

[45] Jan. 24, 1978

[54] ELECTROSTATIC FLUIDIZED BED COATING UNIT

[75] Inventors: Douglas C. Nethersole, Laval; Michael A. Dudley, Toronto; Mellapalayam R. Parthasarathy, Verdun, all of Canada

[73] Assignee: Canada Wire And Cable Limited, Toronto, Canada

[21] Appl. No.: 683,774

[22] Filed: May 6, 1976

[30] Foreign Application Priority Data

Feb. 26, 1976 Canada ..... 246617

[51] Int. Cl.[2] ..... B05C 19/02

[52] U.S. Cl. ..... 118/629; 118/309

[58] Field of Search ..... 118/405, 404, 309, 312, 118/634, DIG. 5, 603, 629, 608; 427/185

[56] References Cited

U.S. PATENT DOCUMENTS

| | | | |
|---|---|---|---|
| 3,560,239 | 2/1971 | Facer et al. | 427/185 X |
| 3,566,833 | 3/1971 | Beebe et al. | 118/405 X |
| 3,589,335 | 6/1971 | Chester et al. | 118/DIG. 5 |
| 3,921,576 | 11/1975 | Vertue | 118/634 |

FOREIGN PATENT DOCUMENTS

| | | | |
|---|---|---|---|
| 993,566 | 5/1965 | United Kingdom | 427/185 |

*Primary Examiner*—John P. McIntosh
*Attorney, Agent, or Firm*—Fleit & Jacobson

[57] ABSTRACT

An electrostatic fluidized bed coating unit is disclosed. The coating unit comprises a plenum chamber with means for ingress of a gas under a greater than atmospheric pressure, a porous plate located on top of the plenum chamber and extending to the limits of the containing walls of the plenum chamber, containing walls for powder immediately above the porous plate and forming essentially a continuation of the plenum chamber walls, a coating chamber secured to such powder containing walls, and an exhaust system for effecting a uniform fluidizing gas removal from an area essentially directly above the porous plate.

13 Claims, 3 Drawing Figures

ELECTROSTATIC FLUIDIZED BED COATING UNIT

This invention relates to an electrostatic fluidized bed powder coating unit and more particularly to an exhaust system for the coating chamber of an electrostatic fluidized bed coating unit.

Electrostatic fluidized bed systems are a well known art in the field of powder coating. In such systems, the powder material which is essentially 100% solids is kept fluidized in a bed by dry air passing through a porous base plate. The powder particles are charged either by means of an electrode in the fluid bed beneath the surface of the fluidizing powder or by charge transfer from the pre-ionized air. The fluidizing effect plus the charge repulsion effect of the powder particles result in an upward motion of the particles to form a cloud above the bed. An elongated substrate or any other object passing axially across or vertically through the bed and through the powder cloud becomes deposited with a layer of the powder material.

While electrostatic fluidized bed powder coating systems are known, difficulties have been experienced in producing a dense and essentially stable, uniform powder cloud within the coating chamber. Exhaust mechanisms in conventional electrostatic fluidized beds and cloud coaters are either non-existent or are such as to draw powder particles through preferred and confined locations. The effect is a distortion in the vertical line of travel of the powder which immediately upon fluidization tends to travel in a line directly to the exhaust ports. The result is a varying degree of cloud density at any specific location in the coating chamber and heavy powder concentrations in the vincinity of the exhaust ports.

Furthermore, conventional beds have relatively small exhaust hoods which permit heavy powder accumulation on their sides with subsequent drop off onto the object being coated.

In addition, dead spots of zero fluidization have often presented problems due to such fittings as flanges, screws, etc. that are installed within the bed. This effect is due to lack of air flow through the porous plate at these spots thus stagnating the powder directly above and resting thereon and also due to non-uniform flow of the air through the porous plate close to such flanges.

The object of the present invention is to provide an electrostatic fluidized bed powder coating unit and particularly to a cloud coater which enables development and control of a stable cloud of essentially uniform powder density above the main body of the fluidizing powder, and which also enables development of uniform fluidization of powder particles across the entire area of the bed.

The electrostatic fluidized bed coating unit, in accordance with the invention, for applying charged powder particles continuously onto discrete or elongated objects comprises a plenum chamber with means for ingress of a gas under a greater than atmospheric pressure, a porous top plate for such plenum chamber extending to the limits of the containing walls of the plenum chamber, containing walls for powder immediately above the porous plate and forming essentially a continuation of the plenum chamber walls, a coating chamber secured to the powder containing walls, and an exhaust system for effecting a substantially uniform fluidizing gas removal from an area essentially directly above the porous plate.

In a preferred embodiment of the invention, the roof of the coating chamber is covered by a perforated plate which occupies the area directly above the fluidized bed, other portions of the coating chamber being covered completely. The perforated plate could be positioned either horizontally or inclined to the horizontal. The exhaust system situated above the perforated plate could either be enclosed by a hood or open to the atmosphere. In either cases, the area immediately above the perforated plate is maintained at a pressure lower than atmospheric pressure by means of a suction unit so as to draw the fluidizing air through the openings in the perforated plate. The perforated plate may also have holes of various predetermined sizes and predetermined locations so as to ensure a substantially uniform suction of powder particles across the entire area of the fluidized bed.

In a preferred embodiment, there are adjustable openings on either side of the exhaust hood, the purpose of which is to enable control of the reduced pressure inside the hood and hence of the rate of air suction through the perforated plate arrangement.

The coating chamber, exhaust hood and the perforated plate are preferably kept vibrated to minimize powder accumulation on the perforated plate and on the walls of the chamber.

The pressure in the coating chamber is preferably maintained at slightly less than atmospheric pressure. This is particularly advisible with horizontal coating units to prevent loss of fluidized powder through the openings in the ends of the coating chamber for the passage of the objects to be coated. Vertical coating units can be maintained at a pressure slightly positive provided that such pressure is less than the plenum chamber pressure.

In a preferred embodiment of the invention, the ceiling of the coating chamber is at least one foot above the porous plate to minimize variation of the air velocity within the coating chamber and, in the case of a horizontal coating unit, to minimize the amount of air required to be drawn in through the openings provided for the passage of the articles to be coated.

In a horizontal coating unit, the width of the coating chamber is preferably equal to that of the fluidized bed whereas the length thereof preferably extends to at least four inches from both ends of the bed to limit the cloud distortion within the coating chamber by air entering through the end openings. The floor of the extended portion of the coating chamber is secured to the side of the containing walls of the bed and slopes down outwards from such containing walls. Overflow powder material from the bed slides down the floor of the coating chamber and discharges through openings at the lower end of such floor so as to control the height of powder above the porous plate. Vibration of the unit also enhances discharge of overflow powder along the floor of the coating chamber. The above overflow system can also be used with vertical coating units.

In a particular embodiment of the invention, flanges for clamping the porous plate are provided on the outer periphery of the walls of the plenum chamber and of the containing walls of the bed thus making the entire area of the porous plate within the bed available for fluidization of the powder. Also the air flow from the plenum chamber below the porous plate is undiverted close to the walls and thus the pressure exerted by the fluidizing air on the porous plate is essentially uniform over the entire area of the porous plate.

The invention will now be disclosed, by way of example, with reference to the accompanying drawings wherein.

Figure 1:
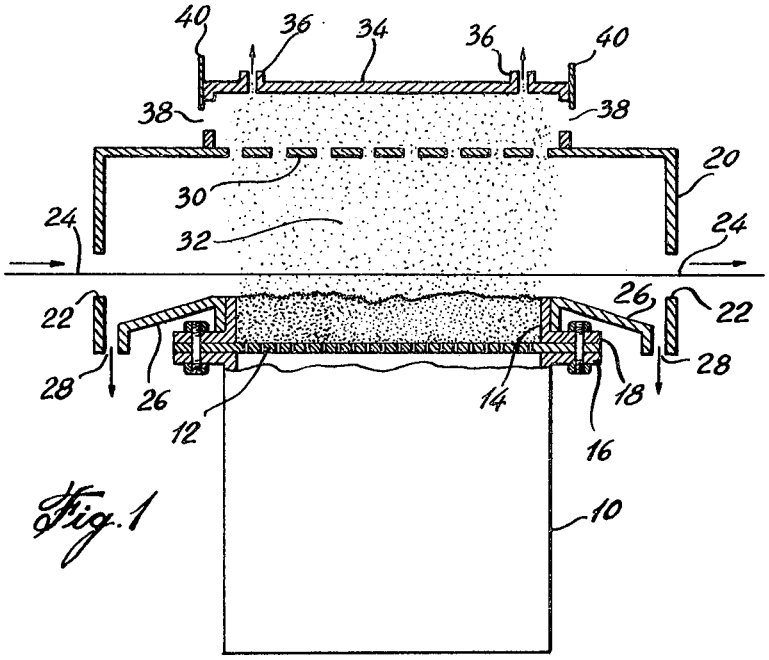
FIG. 1 illustrates a side view of a horizontal coating unit.

Referring to FIG. 1, there is shown an electrostatic fluidized bed coating unit comprising a plenum chamber 10 closed at its top by a porous plate 12, and containing walls 14 for fluidized powder immediately above the porous plate 12, such porous plate 10 being clamped in position between the plenum chamber and the containing walls 14 by means of flanges 16 and 18 extending outwards along the periphery of the plenum chamber 10 and containing walls 14. This arrangement enables uniform fluidization of the powder material across the entire area of the porous plate. A coating chamber 20 is secured to the containing walls. In the embodiment of FIG. 1, which illustrates a horizontal coating unit, the coating chamber has openings 22 on both ends for the passage of objects to be coated, such as substrate 24. The coating chamber is preferably maintained at a slightly less than atmospheric pressure to prevent loss of powder through openings 22. The ceiling of the coating chamber is at least one foot above the porous plate to minimize variation of the air velocity within the coating chamber and to minimize the amount of air required to be drawn in through the openings 22 due to the negative pressure of the coating chamber. The width of the coating chamber is preferably equal to that of the containing walls of the coating unit. However, the length of such coating chamber extends at least 4 inches from both ends of the containing walls 14 to limit the cloud distortion within the coating chamber by air entering through the end openings 22 for the passage of the elongated substrate 24 to be coated. Each extended portion of the coating chamber has a floor 26 secured to the side of the containing walls and such floor has openings 28 in the lower portion thereof for powder overflow. As more clearly disclosed in U.S. patent application Ser. No. 683,775 entitled "Continuous Powder Feed System and Process for Maintaining a Uniform Powder Coating Thickness on Objects being Coated by Electrostatic Fluidized Beds," the height of the fluidized bed of powder can be maintained constant by continuous feed of powder material and overflow of excess powder over containing walls 14, down sloping floor 26 and out through openings 28 into a suitable collecting device (not shown).

Figure 2:
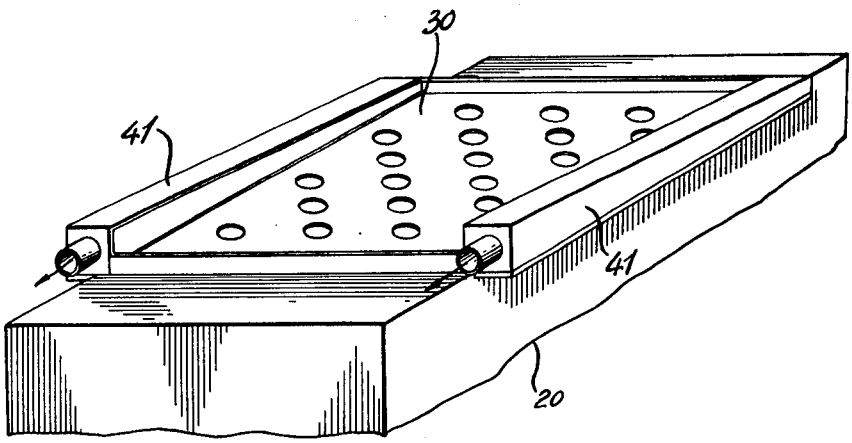
FIG. 2 illustrates a perspective top view of a horizontal coating unit.

The top of the coating chamber directly above the porous plate 12 is covered by a perforated plate 30. An exhaust system is situated above the perforated plate to effect a uniform fluidizing gas removal rate from the area 32 essentially directly above the porous plate. This exhaust system shown in FIG. 1 consists of a hood 34 maintained at a pressure lower than atmospheric pressure by means of suction through exhaust ports 36. The exhaust hood 34 has optional openings 38 with adjustable doors 40 to enable control over the rate of air suction through the perforated plate 30. The exhaust system could also be open to the atmosphere as shown in FIG. 2 and other means such as exhaust ducts 41 used to maintain the area above the perforated plate at a pressure lower than atmospheric pressure. The exhaust system will maintain the coating chamber at a pressure slightly less than atmospheric pressure as mentioned previously. The holes in the perforated plate 30 may be of various predetermined sizes and predetermined locations so as to effect a uniform fluidizing gas removal from the area essentially directly above the porous plate 12.

Figure 3:
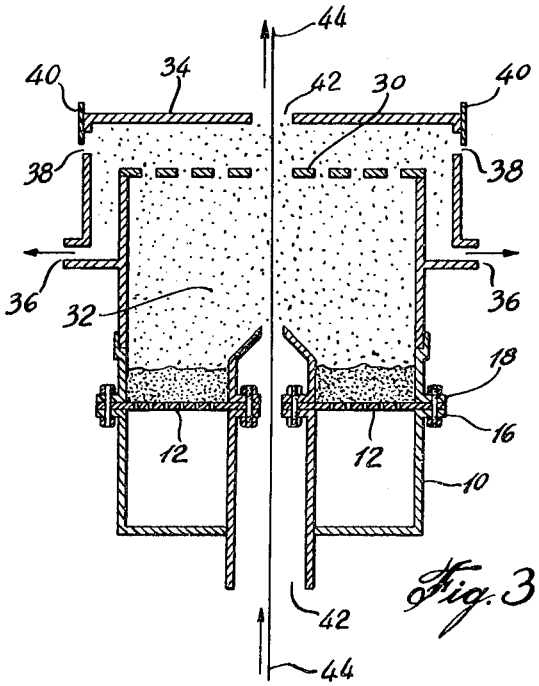
FIG. 3 illustrates a side view of a vertical coating unit.

FIG. 3 illustrates a vertical coating unit having openings 42 at top and bottom for passage of objects such as substrate 44. The remaining elements of FIG. 3 are identical to the one of FIG. 1 and have been identified by the same reference characters. This embodiment may also be equipped with means for controlling the depth of powder in the coating unit as illustrated in FIG. 1.

The following three examples demonstrate different facets of the novel coating chamber which result in the production of higher quality coatings of reduced thickness variation, while permitting more efficient utilization of powder from the bed.

EXAMPLE I

In the first example the beneficial effect of the perforated plate is demonstrated in obtaining heavier coating deposits, while using less powder from the bed for the coating operation. In both tests with and without the insertion of the porous plate in the location shown in FIG. 1 the same rate of air draw off through ports 36 was maintained.

The coating was carried out using an ionomeric powder, deposited onto 25 AWG copper wire running at a line speed of 50 fpm. Results are listed in Tables I and II.

TABLE I

COMPARISON OF COATING THICKNESS WITH AND WITHOUT PERFORATED PLATE

| Perforated plate in position | YES | NO |
|---|---|---|
| | Average thickness of Deposited Film (in./side) | |
| Charging Voltage 60 Kv | 0.0032 | 0.0018 |
| Charging Voltage 55 Kv | 0.0029 | 0.0014 |

TABLE II

COMPARISON OF POWDER UTILIZATION WITH AND WITHOUT PERFORATED PLATE

| Perforated plate in position | YES | NO |
|---|---|---|
| Loss of powder depth in bed after ½ hr. fluidized coating operation. | ⅛" | ⅜" |

The uniform and dense cloud obtainable with the perforated plate is demonstrated through the results depicted in Table I where the use of the same resulted in a heavier coating build. The adverse effect of exhausting the chamber direct to the ports rather than via the baffles of the perforated plate is evident from the results depicted in Table II.

EXAMPLE II

This example demonstrates the surprising improved longitudinal thickness uniformity that can be obtained through increasing the volume of the chamber, by specifically raising the height of the perforated plate and attached exhaust ports. Table III gives the results of coating thicknesses obtained at two different coating chamber heights. An improved uniformity in coating build is obtained with the enlarged coating chamber due to lesser effects of turbulence caused by suction through exhaust. A pronounced effect in deposition efficiency is also noticeable with a higher chamber ceiling and perforated plate due to a more uniform suction of powder particles and thus a greater influence of electrostatic forces over dynamic forces.

TABLE III

EFFECT OF CHAMBER CEILING HEIGHT ON LONGITUDINAL THICKNESS UNIFORMITY

| | Thickness of ionomeric coating deposited on 25 AWG copper wire at 50 fpm | | | | | | | |
|---|---|---|---|---|---|---|---|---|
| | at chamber ceiling height of 7½ in. from porous plate | | | | at chamber ceiling height of 16 in. from porous plate | | | |
| Charging Voltage | Max. ("/side) | Min. ("/side) | avge. ("/side) | % devn. from avge. | Max. ("/side) | Min. ("/side) | avge. ("/side) | % devn. from avge. |
| 45 Kv | 0.0066 | 0.0048 | 0.0056 | 17.4 | 0.0074 | 0.0069 | 0.0072 | 3.9 |
| 50 Kv | 0.0061 | 0.0040 | 0.0049 | 24.5 | 0.0073 | 0.0062 | 0.0069 | 10.1 |

EXAMPLE III

The effect on insulation continuity resulting from a one foot extension of the coating chamber on both side of a horizontal coating unit as described in FIG. 1, is illustrated by the data in Tables IV and V. This extension results in reduced powder agglomeration on the inner faces of the coating chamber transverse walls thus minimizing powder fall-off onto the conductor during processing, and consequently eliminates a potential contributing source to coating defects as evidenced by electrical faults when a test run was made using a copper conductor.

An ionomeric powder was deposited on 25 AWG copper wire for both evaluations. Processing line speeds were 55 and 100 fpm for the standard and extended coater runs respectively. Insulation continuity was determined at an applied potential of 3.5 Kv AC for 0.25 seconds using a bead-chain electrode.

TABLE IV

ELECTRICAL FAULT FREQUENCY CHANGE WITH TIME

| TIME (MINS.) | STANDARD COATER (faults) | COATER AS PER INVENTION (faults) |
|---|---|---|
| 0–10 | 0 | 0 |
| 10–20 | 0 | 0 |
| 20–30 | 1 | 0 |
| 30–40 | 2 | 1 |
| 40–50 | 5 | 0 |
| 50–60 | 2 | 0 |
| 60–70 | 4 | 1 |
| 70–80 | 6 | 1 |
| 80–90 | 1 | 1 |
| 90–100 | 7 | 1 |

TABLE V

ELECTRICAL FAULT FREQUENCY PER 1000 FT. LENGTH

| LENGTH (FT.) | STANDARD COATED | COATER AS PER INVENTION |
|---|---|---|
| 0–1000 | 0 | 0 |
| 1000–2000 | 3 | 0 |
| 2000–3000 | 7 | 1 |
| 3000–4000 | 10 | 1 |
| 4000–5000 | 8 | 0 |

Tables IV and V clearly indicate the effect of powder build-up on the walls and subsequent drop-off from the standard coater, resulting in an increase in the number of faults with time, to a more or less constant high level. Using the coating chamber as described in FIG. 1 the faults are random with time and at a much lower level, providing a product of superior coating quality.

Although the invention has been disclosed with reference to preferred embodiments thereof, it is to be understood that various modifications may be made thereto and that the invention is to be limited only by the following claims;

What is claimed is:

1. An electrostatic fluidized bed coating unit for applying charged powder particles continuously onto discrete or elongated objects comprising:

a. a plenum chamber with means for ingress of a gas under a greater than atmospheric pressure;

b. a porous top plate for said plenum chamber extending to the limits of the containing walls of said plenum chamber;

c. containing walls for powder immediately above the porous plate and forming essentially a continuation of the plenum chamber walls;

d. a coating chamber secured to said powder containing walls; and e. an exhaust system means for effecting a substantially uniform fluidizing gas and powder removal across the entire area essentially directly above the porous plate.

2. An electrostatic fluidized bed coating unit as defined in claim 1, wherein said exhaust system means includes a perforated plate occupying only the area directly above the fluidized bed, and suction means for maintaining a pressure lower than atmospheric pressure in the area immediately above the perforated plate so as to draw the fluidizing gas and powder through the openings in the perforated plate.

3. An electrostatic fluidized bed coating unit as defined in claim 2, wherein the exhaust system means includes a hood located above said perforated plate and means for maintaining the hood at a pressure lower than atmospheric pressure.

4. An electrostatic fluidized bed coating unit as defined in claim 3, wherein adjustable openings to the atmosphere are provided in said hood to enable control of the rate of venting of air from the coating chamber.

5. An electrostatic fluidized bed coating unit as defined in claim 2, wherein the exhaust system means is open to the atmosphere and further comprising exhaust ducts adjacent to the top of the perforated plate and connected to said suction means for maintaining the area above the porous plate at a pressure lower than atmospheric pressure.

6. An electrostatic fluidized bed coating unit as defined in claim 2, wherein the holes in the perforated plate are of various different predetermined sizes and in predetermined locations to effect a substantially uniform suction of powder particles across the entire area of the fluidized bed.

7. An electrostatic fluidized bed coating unit as defined in claim 1, wherein the coating chamber is maintained at slightly less than atmospheric pressure.

8. An electrostatic fluidized bed coating unit as defined in claim 7, wherein the ceiling of the coating chamber is at least one foot above the porous plate to minimize variation of the air velocity within the coating chamber and, in the case of a horizontal coating unit having end openings for the passage of the objects to be coated, to minimize the amount of air required to be drawn through the openings provided for the passage of the articles to be coated.

9. An electrostatic fluidized bed coating unit as defined in claim 7, wherein the coating chamber is a horizontal coating chamber having end openings for the passage of the objects to be coated and wherein the width of the coating chamber is equal to the width of the fluidized bed but the length thereof extends to at least four inches from both ends of the fluidized bed to limit distortion of the cloud within the coating chamber by air entering through the end openings due to the negative pressure of the coating chamber.

10. An electrostatic fluidized bed coating unit as defined in claim 9, wherein at least one of the containing walls form a powder retaining wall for the fluidized bed, said powder retaining wall having a height such as to determine the powder level of the fluidized bed and also permit a uniform overflow of excess powder from the fluidized bed across the length of said powder retaining wall, and wherein the extended portion of the coating chamber includes a sloping floor which is secured to the side of said powder retaining wall and has openings at its lower end for overflow of excess powder from the coating chamber over said powder retaining wall.

11. An electrostatic fluidized bed coating unit as defined in claim 1, wherein the coating chamber is a vertical coating chamber and wherein the pressure within the coating chamber is a positive pressure less than the plenum chamber pressure.

12. An electrostatic fluidized bed coating unit as defined in claim 1, wherein flanges for clamping the porous plate to extend outward from the walls of the plenum chamber and of said containing walls so that within the coating chamber air may pass unhindered through the porous plate right up to the limits of the containing walls of the plenum chamber.

13. An electrostatic fluidized bed coating unit as defined in claim 1, further comprising means for vibrating the whole coating chamber.

* * * * *